United States Patent [19]

Brown

[11] 4,330,961

[45] May 25, 1982

[54] SWING TYPE INTERNAL GRINDING FIXTURE FOR CYLINDRICAL GRINDING MACHINES

[75] Inventor: Sterling L. Brown, Waynesboro, Pa.

[73] Assignee: Litton Industrial Products, Inc., Waynesboro, Pa.

[21] Appl. No.: 151,208

[22] Filed: May 19, 1980

[51] Int. Cl.[3] ..... B24B 5/12

[52] U.S. Cl. ..... 51/3; 51/166 TS

[58] Field of Search ..... 51/3, 99, 166 TS, 33 R, 51/33 W, 47, 165.85

[56] References Cited

U.S. PATENT DOCUMENTS

| | | | |
|---|---|---|---|
| 2,063,659 | 12/1936 | Booth | 51/3 |
| 2,403,341 | 7/1946 | Carlson | 51/33 R |
| 2,909,013 | 10/1959 | Hollengreen | 51/166 TS |
| 4,077,163 | 3/1978 | Bennett | 51/33 W |
| 4,209,948 | 7/1980 | Obear | 51/99 |

FOREIGN PATENT DOCUMENTS

| | | | |
|---|---|---|---|
| 476148 | 12/1975 | U.S.S.R. | 51/99 |

*Primary Examiner*—Nicholas P. Godici
*Attorney, Agent, or Firm*—Spencer T. Smith

[57] ABSTRACT

A cylindrical grinding machine comprising a workholding assembly for holding a workpiece having inner and outer diameters for rotation about its axis, and wheelhead means including first cylindrical grinding wheel assembly means including a grinding wheel for grinding the outer diameter of a cylindrical workpiece held by the workholding assembly, second pivotally mounted cylindrical grinding wheel assembly means for grinding the inner diameter of a cylindrical workpiece held by the workholding assembly, means including a two direction hydraulic motor for pivotally displacing the second cylindrical grinding wheel assembly means from a raised remote position to a grind position for maintaining the second cylindrical grinding wheel assembly means at the grinding position, and means for locating the second cylindrical grinding wheel assembly at a precise axial position as the second cylindrical grinding wheel assembly is pivotally displaced to the grinding position including a key and keyway for matingly engaging with the key.

3 Claims, 3 Drawing Figures

SWING TYPE INTERNAL GRINDING FIXTURE FOR CYLINDRICAL GRINDING MACHINES

The present invention relates to cylindrical grinding machines capable of effecting stock removal from either an inner or outer diameter of a cylindrical workpiece rotating about its axis, and more particularly, to such a machine utilizing a swing-type internal grinding assembly.

A swing-type internal grinding fixture for a cylindrical grinding machine is disclosed in U.S. Pat. No. 2,909,013. In such a machine the internal grinding fixture is manually displaced and held at a remote position by a spring latch mechanism or clamp and is held at a grinding position by securing a nut onto a bolt which is secured to the wheelhead housing and which projects through a suitable opening of the fixture housing.

It is an object of the present invention is to provide a cylindrical grinding machine having an improved swing-type internal grinding fixture.

Other objects and advantages of the present invention will become apparent from the following portion of this specification and from the accompanying drawings which illustrate, in accordance with the mandate of the patent statutes, a presently preferred embodiment incorporating the principles of the invention.

Referring to the drawings.

Figure 1:
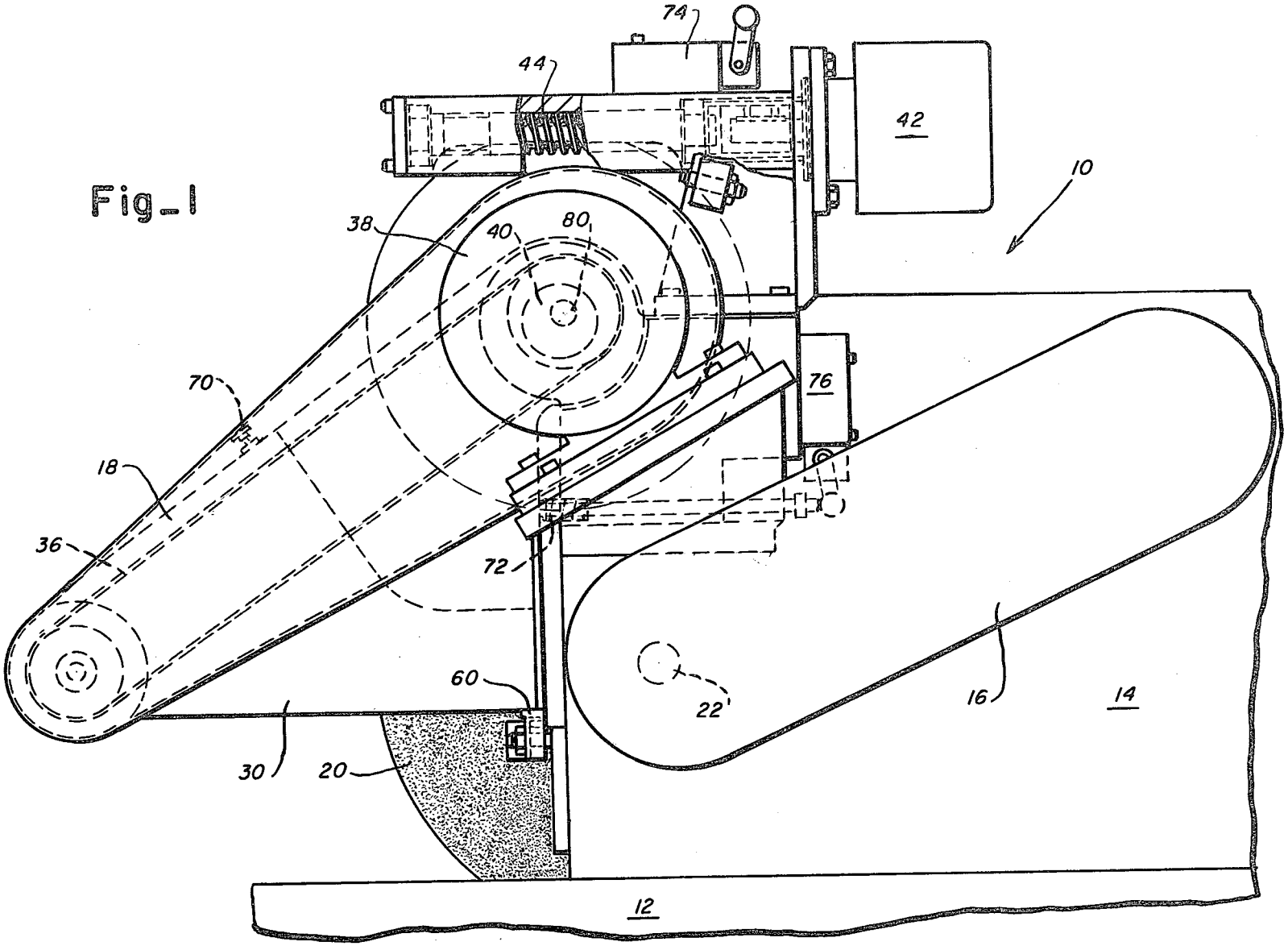
FIG. 1 is an elevational view of a cylindrical grinder wheelhead assembly made in accordance with the teachings of the present invention.

The cylindrical grinding machine includes a wheelhead assembly 10 having a slide 12 which is slidably displaceable on ways or the like of a rotatable base support (not shown) permitting the wheelhead assembly to be selectively positioned.

The wheelhead assembly 10 includes a housing 14 which supports two grinding wheel assemblies 16 and 18 for grinding external (O.D.) and internal (I.D.) surfaces of a cylindrical workpiece, respectively. The O.D. grinding wheel assembly 16 includes a grinding wheel 20 rotatably mounted to the wheelhead housing 14 on a spindle 22. The I.D. grinding wheel assembly includes a pivotal bracket 30 which supports a spindle 32 upon which a second grinding wheel 34 rotates. This second grinding wheel 34 is rotatably driven via belts 36 by a motor 38 mounted on the wheelhead housing 14.

Figures 2, 3:
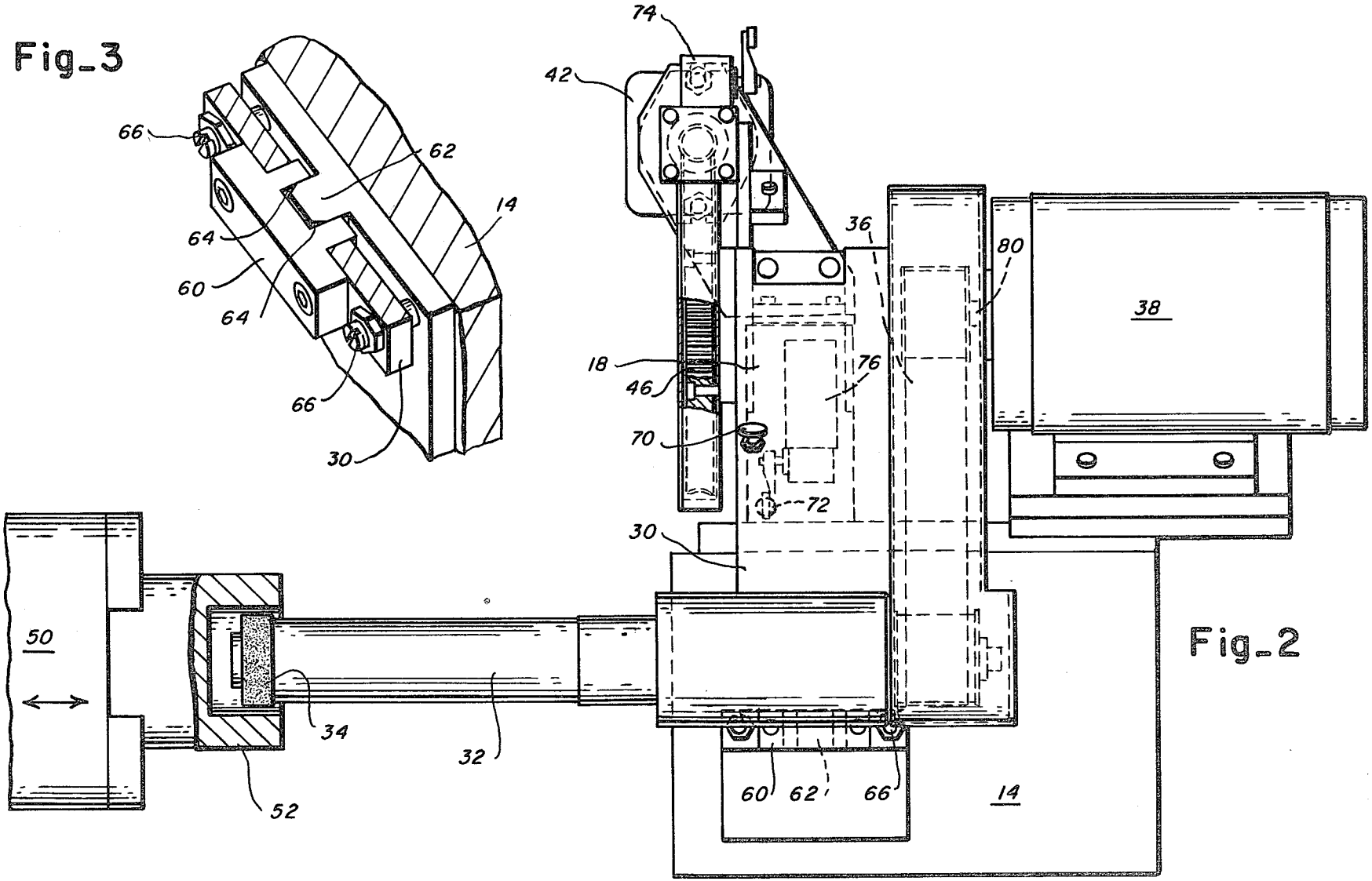
FIG. 2 is a front view of the wheelhead assembly showing only the swing-type internal grinding wheel assembly which is in grinding engagement with the I.D. of a workpiece held in a chuck.
FIG. 3 is a perspective view of the axial positioning keyway of the swing-type internal grinding assembly engaged with the mating key of the wheelhead housing.

The I.D. grinding assembly bracket 30 is displaceable about a pivot shaft 40 and can be displaced between a remote position and a grind position (shown) by a bidirectional hydraulic motor 42 secured to the wheelhead housing 14 and having a worm shaft 44 which drivingly engages with a worm wheel 46 fixedly secured to the support bracket 30. As shown in FIG. 2, when the I.D. assembly is in the lowered grind position, a rotatable chuck 50 axially advances a rotating workpiece 52 which abrasively engages the I.D. grinding wheel 34.

To precisely position the axis of the I.D. grinding wheel, the I.D. grinding assembly bracket 30 includes a keyway 60 which matingly receives a key 62 on the wheelhead housing as the bracket is displaced towards the grind position. The key 62 has bevelled edges 64 to cam the keyway 60 into precise axial position. The angular position of the I.D. grinding wheel assembly is established by adjusting screws 66. Forceful contact between the support bracket 30 and the wheelhead housing 14 is established and maintained by the hydraulic motor 42.

The I.D. grinding wheel assembly 18 also includes stops 70 and 72 for operating switches 74 and 76 at the raised and lowered positions to generate signals conditioning a control device to permit infeed of the wheelhead assembly 10 and energization of either the I.D. or O.D. motor drive.

The I.D. grinding assembly pivot or shaft 40 is offset from the I.D. grinding wheel motor shaft 80 so that the tension on the belts 36 will progressively decrease as the I.D. grinding wheel assembly bracket 30 is pivotally displaced from the grinding or lowered position to the raised or remote position.

The invention claimed is:

1. A cylindrical grinding machine for grinding both inner and outer diameters of a cylindrical workpiece comprising a workholding assembly for holding and rotating the workpiece, and wheelhead means including first cylindrical grinding wheel assembly means including a grinding wheel for grinding the outer diameter of the cylindrical workpiece held by said workholding assembly, second pivotally mounted cylindrical grinding wheel assembly means including a second grinding wheel for grinding the inner diameter of the cylindrical workpiece held by said workholding assembly, said second cylindrical grinding wheel assembly means pivotally displaceable from a raised remote position to a predetermined grinding position, mean for selectively defining said grinding position at a precise axial location including a key and a keyway for matingly engaging with said key, hydraulic motor means operable in a first direction for pivotally displacing said second cylindrical grinding wheel assembly means from said remote position to said grinding position such that said key engages said keyway and operable in a second direction for displacing said second cylindrical grinding wheel assembly means from said grinding position to said remote position such that said key disengages said keyway, and means for maintaining said second cylindrical grinding wheel assembly means in said predetermined grinding position during a grinding operation comprising operating said hydraulic motor means in said first direction.

2. A cylindrical grinding machine according to claim 1, further comprising motor means including a drive shaft, belt means for drivingly interconnecting said second cylindrical grinding wheel and said motor means, said drive shaft and the pivot axis of said second grinder wheel assembly being selectively offset for progressively loosening said belt means as said second grinding wheel assembly is pivotally displaced from said grind position to said remote position.

3. A cylindrical grinding machine according to claim 1, wherein said hydraulic motor means includes a worm shaft and said second pivotally mounted grinding wheel assembly means includes a worm gear operatively associated therewith.

* * * * *